US010794158B2

(12) United States Patent
Cornelissen

(10) Patent No.: US 10,794,158 B2
(45) Date of Patent: Oct. 6, 2020

(54) METHOD FOR SEALING CAVITIES IN OR ADJACENT TO A CURED CEMENT SHEATH SURROUNDING A WELL CASING

(71) Applicant: SHELL OIL COMPANY, Houston, TX (US)

(72) Inventor: Erik Kerst Cornelissen, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 0 days.

(21) Appl. No.: 16/346,026

(22) PCT Filed: Oct. 30, 2017

(86) PCT No.: PCT/EP2017/077817

§ 371 (c)(1),
(2) Date: Apr. 29, 2019

(87) PCT Pub. No.: WO2018/083069

PCT Pub. Date: May 11, 2018

(65) Prior Publication Data

US 2019/0264547 A1 Aug. 29, 2019

(30) Foreign Application Priority Data

Nov. 1, 2016 (EP) ..... 16196704

(51) Int. Cl.
*E21B 43/10* (2006.01)
*E21B 33/14* (2006.01)
*E21B 33/13* (2006.01)

(52) U.S. Cl.
CPC ..... *E21B 43/105* (2013.01); *E21B 33/13* (2013.01); *E21B 33/14* (2013.01)

(58) Field of Classification Search
CPC ..... E21B 23/01; E21B 23/02; E21B 33/14; E21B 43/105
See application file for complete search history.

(56) References Cited

U.S. PATENT DOCUMENTS 3,167,122 A * 1/1965 Lang ..... E21B 29/10 166/277
3,477,506 A * 11/1969 Malone ..... E21B 29/10 166/207

(Continued)

FOREIGN PATENT DOCUMENTS

WO 2015117223 A1 8/2015
WO 2017091911 A1 6/2017

OTHER PUBLICATIONS

International Search Report and Written Opinion received for PCT Patent Application No. PCT/EP2017/077817, dated Jan. 19, 2018, 9 pages.

(Continued)

*Primary Examiner* — Shane Bomar

(57) ABSTRACT

A method for sealing cavities in or adjacent to a cured cement sheath (4) surrounding a well casing (3) of an underground wellbore comprises: —providing an expansion device (1) with edged expansion segments (2) that is configured to be moved with the expansion segments (2) in an unexpanded configuration up and down through the well casing (3); —moving the unexpanded expansion device (1) to a selected depth in the well casing (3); and —expanding the edged expansion segments (2) at the selected depth, thereby plastically expanding a selected casing section and pressing the expanded casing section into the surrounding cement sheath thereby sealing the cavities.

13 Claims, 4 Drawing Sheets

(56) References Cited

U.S. PATENT DOCUMENTS

| | | | | |
|---|---|---|---|---|
| 3,720,262 | A | 3/1973 | Grable | |
| 3,857,445 | A * | 12/1974 | Mower | E21B 17/00 166/285 |
| 4,716,965 | A | 1/1988 | Bol et al. | |
| 5,348,095 | A | 9/1994 | Worrall et al. | |
| 6,135,208 | A | 10/2000 | Gano et al. | |
| 6,419,025 | B1 | 7/2002 | Lohbeck et al. | |
| 6,446,323 | B1 | 9/2002 | Metcalfe et al. | |
| 6,497,289 | B1 | 12/2002 | Lance et al. | |
| 6,702,030 | B2 | 3/2004 | Simpson | |
| 6,725,917 | B2 | 4/2004 | Metcalfe | |
| 7,124,826 | B2 | 10/2006 | Simpson | |
| 7,350,584 | B2 | 4/2008 | Simpson et al. | |
| 7,861,783 | B2 | 1/2011 | Baaijens et al. | |
| 8,157,007 | B2 | 4/2012 | Nicolas et al. | |
| 2005/0072569 | A1 * | 4/2005 | Johnston | E21B 43/105 166/297 |
| 2006/0000617 | A1 * | 1/2006 | Harrall | E21B 43/108 166/380 |
| 2006/0124295 | A1 * | 6/2006 | Maguire | E21B 43/105 166/207 |
| 2006/0191691 | A1 * | 8/2006 | Lohbeck | E21B 43/105 166/382 |
| 2006/0243452 | A1 * | 11/2006 | Eckerlin | E21B 43/105 166/380 |
| 2006/0254778 | A1 * | 11/2006 | Nobileau | E21B 33/14 166/380 |
| 2008/0223568 | A1 | 9/2008 | Roggeband et al. | |
| 2010/0319427 | A1 | 12/2010 | Lohbeck | |
| 2012/0018154 | A1 | 1/2012 | James | |
| 2012/0061078 | A1 * | 3/2012 | Algu | E21B 33/14 166/294 |
| 2012/0145381 | A1 * | 6/2012 | Nobileau | E21B 17/14 166/242.1 |
| 2016/0115764 | A1 * | 4/2016 | Farley | E21B 43/108 166/285 |
| 2016/0362968 | A1 | 12/2016 | Kriesels et al. | |
| 2017/0335673 | A1 * | 11/2017 | Burke | E21B 43/108 |
| 2018/0066489 | A1 * | 3/2018 | Pipchuk | E21B 33/13 |
| 2019/0040721 | A1 * | 2/2019 | Kohn | E21B 43/105 |

OTHER PUBLICATIONS

Kunz, Winterhawk Well Abandonment Technical Information Presentation presented on Sep. 25, 2017 by Dale Kunz, 16 pages.

Kupresan et al., "Experimental Assessment of Casing Expansion as a Solution to Microannular Gas Migration", IADC/SPE 168056, 11 pages.

* cited by examiner

METHOD FOR SEALING CAVITIES IN OR ADJACENT TO A CURED CEMENT SHEATH SURROUNDING A WELL CASING

CROSS REFERENCE TO RELATED APPLICATIONS

This is a US national stage application of International Application No. PCT/EP2017/077817, filed 30 Oct. 2017, which claims benefit of priority of European application No. 16196704.7, filed 1 Nov. 2016.

FIELD OF THE INVENTION

The invention relates to a method for sealing cavities in or adjacent to a cured cement sheath surrounding a well casing of an underground wellbore.

BACKGROUND OF THE INVENTION

U.S. Pat. No. 4,716,965 describes a sealing method, wherein a flexible sleeve made of elastomeric foam is wrapped around a well casing in order to seal any micro-annuli between the well casing and cement in the surrounding casing-formation annulus. The known sleeve can only be arranged around the well casing and is not suitable for cladding an inner surface of the well casing since it is prone to damage and detachment therefrom.

In another sealing method, disclosed in U.S. Pat. No. 8,157,007, a well liner or casing is locally expanded at several locations along its length by an inflatable bladder in order to generate zonal isolation. A limitation of this known method is that the expansion force generated by an inflatable bladder is limited so that the bladder is not suitable for expanding a thick walled well casing together with at least an inner part of a surrounding cured cement sheath.

Other solutions to seal a cement sheath surrounding a well casing involve replacing the cement behind de casing and/or adding additional material to improve the sealing in the annular space. These cement replacement and supplementing techniques are known as "section milling and cementing" "perforating-washing and cementing" perforating and squeezing cement or resin" and require on creating access to the annular space by milling or perforating the casing and involve complicated well interventions, some of them need the presence of a costly drilling rig at the well site. The success rate of these cement replacement and or supplementing techniques is limited, generally between 30 and 60%.

SUMMARY OF THE INVENTION

In accordance with the invention there is provided a method for sealing cavities in or adjacent to a cured cement sheath surrounding a well casing of an underground wellbore, the method comprising the steps of:

- providing an expansion device with edged expansion segments that is configured to be moved with the expansion segments in an unexpanded configuration up and down through the well casing;
- moving the unexpanded expansion device to a selected depth in the well casing; and
- expanding the edged expansion segments at the selected depth, thereby pressing circumferentially spaced recesses into an inner surface of the selected casing section and expand the outer surface of the selected the expanded casing section into the surrounding cement sheath thereby sealing the cavities.

These and other features, embodiments and advantages of the method, and of suitable expansion devices, are described in the accompanying claims, abstract and the following detailed description of non-limiting embodiments depicted in the accompanying drawings, in which description reference numerals are used which refer to corresponding reference numerals that are depicted in the drawings.

Similar reference numerals in different figures denote the same or similar objects. Objects and other features depicted in the figures and/or described in this specification, abstract and/or claims may be combined in different ways by a person skilled in the art.

DETAILED DESCRIPTION OF THE DEPICTED EMBODIMENTS

Figure 1:
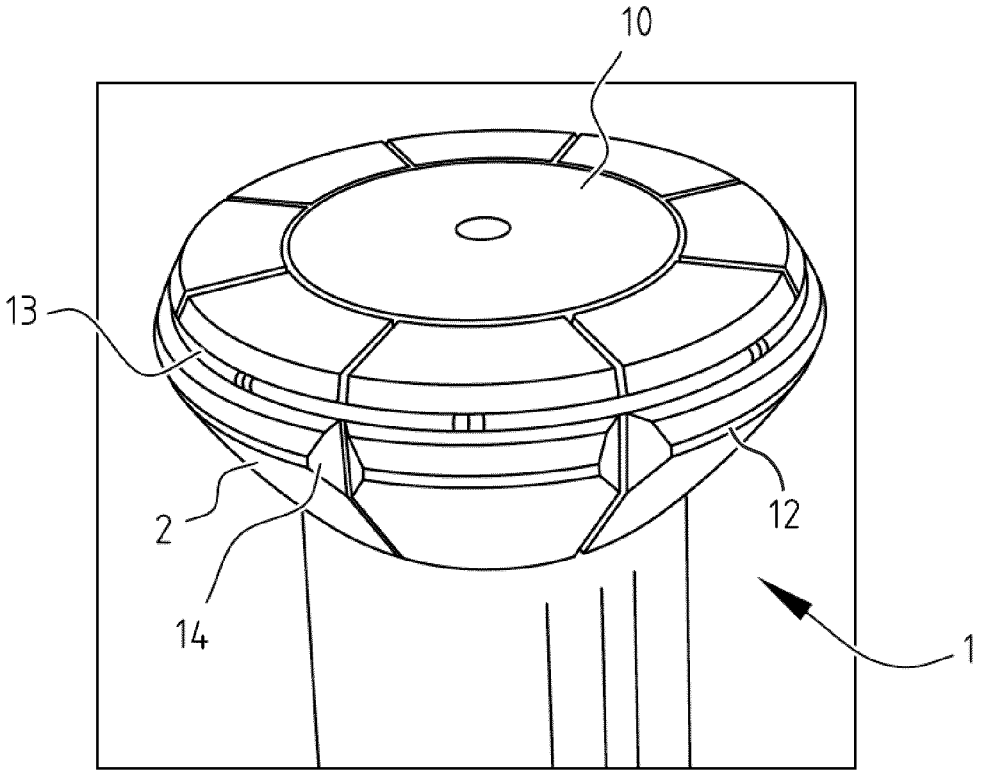
FIG. 1 shows an example of a suitable expansion device, with edged expansion segments in an unexpanded configuration.

Applicant has found there is a need for an improved and reliable cement sheath sealing method that does not rely on replacing or supplementing materials behind the casing and that does not require the casing to be penetrated. There is also a need for an improved cost-effective and reliable cement sealing method that uses in-situ materials already in place and that can be deployed by a robust tool in a simple intervention operation preferably without use of a costly drilling rig. Furthermore, there may be a need for an improved cement sheath sealing method and system that is able to expand a thick-walled well casing or other well liner and at least part of a surrounding cured cement sheath in order to seal micro-annuli and other cavities in and adjacent to the cement sheath and overcomes limitations and drawbacks of known methods and systems for sealing cement sheaths surrounding well casings and other well liners.

By expanding edged expansion segments against a cemented casing at a selected depth, and thereby pressing circumferentially spaced recesses into an inner surface of the casing section, the outer surface of the casing section can be expanded locally into the surrounding cement sheath. It has surprisingly been found that the cavities in the cement sheath can be sealed. It is believed that hardened cement will exhibit plastic deformation under the stress imposed by the local expansion of the selected casing section into the cement sheath. At least part of the outer surface of the expanded casing section and of the surrounding cement sheath may be plastically deformed, as a result of the expansion.

The cavities may be sealed permanently. At least, it has been found that the sealing of the cavities persists after releasing of the expansion device. The retaining effect may be enhanced by plastic deformation of the cement sheath, which may cause the cavities to plastically fill up with cement.

The cavities may comprise micro-annuli in and adjacent to the cured cement sheath and during the expansion step the expansion device may be located at a substantially stationary depth within the wellbore. Optionally, the step of expanding a selected casing section is followed by moving the unexpanded expansion device up or down through the wellbore to another depth where another selected casing section may be expanded to seal micro-annuli and other cavities at that other depth. This may be repeated several times to seal micro-annuli and other cavities at several depths along the length the wellbore.

The method may suitably employ an expansion device for sealing cavities in or adjacent to a cured cement sheath surrounding a well casing of an underground wellbore. The expansion device suitably comprises a series of circumferentially spaced edged expansion segments that are configured to be plastically expand a ring of circumferentially spaced recesses in a selected casing section and thereby press the expanded casing section into the surrounding cement sheath, thereby sealing the cavities.

The expansion device may be suspended from a tubular string, a wireline or an e-line through which electric and optionally hydraulic power and/or signals can be transmitted the expansion device and a control assembly at the earth surface. The expansion segments may have in longitudinal direction substantially V-shaped edges and may be configured to expand the selected casing section such that it has a ring of in longitudinal direction substantially V-shaped recesses, which section is connected to adjacent non-expanded casing sections by smoothly outwardly curved concave semi-expanded casing sections. The longitudinal length of the substantially V-shaped edges may be less than 20 cm, optionally less than 10 cm or less than 5 cm. The expansion device may comprise a hydraulic actuation assembly that radially expands and contracts the expansion segments.

FIG. 1 shows an embodiment of an expansion device 1. The device 1 comprises edged expansion segments 2 and is configured to be moved with the expansion segments 2 in an unexpanded configuration as illustrated in FIG. 1 up and down through a well casing 3 that is shown in FIGS. 2 and 3.

Figure 2:
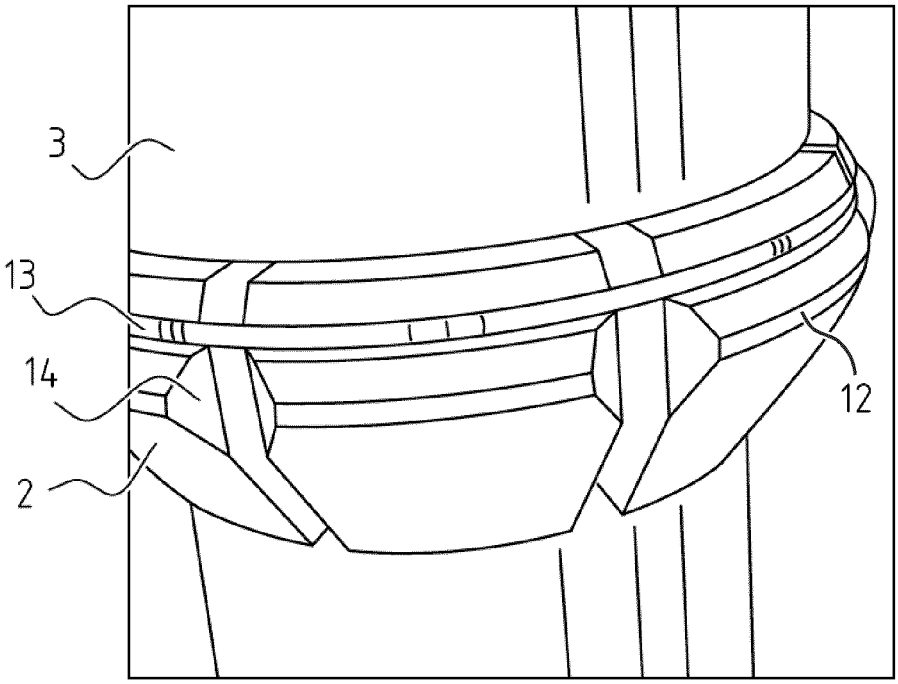
FIG. 2 shows the expansion device of FIG. 1 with the edged expansion segments in an expanded configuration.

FIG. 2 shows a well casing 3 above the expansion device 1 with the edged expansion segments 2 in an expanded configuration.

FIGS. 1 and 2 furthermore show that the expansion segments 2 comprise V-shaped outer edges 12 and a groove in which an O-shaped elastomeric ring 13 is embedded, which ring pulls the expansion segments 2 back into a retracted mode after a local casing expansion operation. The outer edges 12 may, in circumferential direction, be rounded off at the edges, for example by tapered facets 14 shown in FIGS. 1 and 2. Herewith excessive strain concentration can be avoided which might otherwise occur when expanding the segments 2 into the casing wall.

Figure 3:
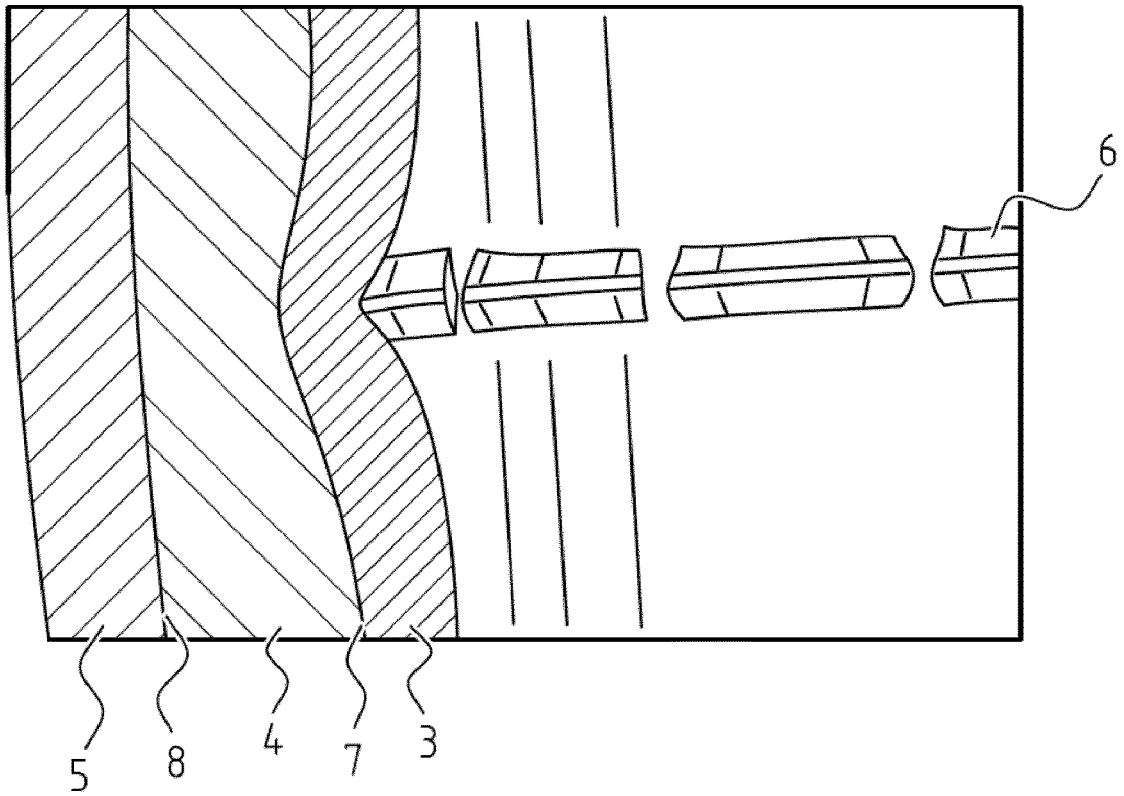
FIG. 3 is a longitudinal sectional view of a cemented well casing of which a short section has been expanded and pressed into the surrounding cement sheath by the edged expansion segments.

FIG. 3 is a longitudinal sectional view of the well casing 3 of which a short section has been expanded and pressed into the surrounding cement sheath 4 by the edged expansion segments 2.

The circumferentially spaced V-shaped recesses 6 are areas where the V-shaped expansion segments 2 have been radially pressed into the well casing 3.

The presently proposed local casing expansion method and system may be used as a remediation and/or repair technique for existing wells where a well casing string 3, which may comprise interconnected casing or liner sections, well screens and/or other tubulars, is cemented inside an outer casing 5 or rock and where there is a leak of fluids or gas in the annular area along the length of the wellbore, through the interface between the cured, hard cement and the casings or rock.

FIG. 3 shows one of an optional range of longitudinally spaced ring-shaped expansions 6 of the inner well casing 3, whereby the outside of the casing 3 compresses the surrounding cement sheath 4 and thereby improves the bond and sealing-interface 7 between the cement sheath 3 and the inner casing 3 and also the sealing interface 8 between the cement sheath 4 and the outer well casing 5 or rock. The locally applied stress from expansion of the inner casing 3 against the confined and hard cement sheath 4 is such that the confined cement directly behind the expanded ring plastically deforms, which results in improved sealing interfaces 7 and 8.

In operation, the unexpanded expansion device 1 may be lowered into the wellbore. The unexpanded expansion device 1 is moved to a selected depth in the well casing. This typically involves lowering the unexpanded expansion device 1 to said selected depth. The expansion device 1 is configured such that it can perform multiple extrusions in sequence along the length of the wellbore in a single deployment and can be easily conveyed into the wellbore to the place of interest.

FIG. 1 furthermore shows that the expansion device 1 comprises a cone shaped expander 10, that drives the edged expansion segments 2 against and into the well casing 3 as illustrated in FIG. 3. The shaped expander 10 may suitably be a faceted wedge, which can be moved in longitudinal direction relative to the edged segments 2. Each of the facets may contact one of the edged expansion segments 2.

The V-shaped expansion segments 2 are pushed radially outward while the cone shaped expander 10 is moved axially relative to the casing 3 and expansion segments 2 over a fixed stroke length to generate a predetermined diameter increase or a predetermined force exerted on the casing 3.

The angle of the cone shaped expander 10 and matching contact areas with the expansion segments 2 are engineered to optimize force generated while minimizing friction, and preventing wear and deformation of the surfaces. The shape of the expansion segments 2 is engineered to maximize the local extrusion of the casing while preventing casing failure and deformation of the contact area of the segments.

The cone shaped expander 10 may be actuated by a multi-piston hydraulic actuator to optimize the relation between force required, working pressure and diameter limitation.

Hydraulic pressure may be generated by a downhole hydraulic pump and/or by hydraulic power generated by a hydraulic pump at the earth surface that is transmitted to the expansion device via a small diameter coiled tubing, known as a capillary tube. Fluid for actuation of the hydraulic cylinder may be carried and stored in the expansion device 1.

The expansion device 1 may be moved through the wellbore using various deployment techniques such as slickline, e-line, coiled-tubing or jointed pipe. A preferred conveyance method for the moving the expansion device 1 through the well is by means of a wireline, in which case no drilling rig is required for deployment.

Laboratory tests with the expansion device 1 have shown that:

Hard cement confined within an annular space between pipes will exhibit plastic deformation under stress.

Application of the method has resulted in a 100-fold reduction of leak rate with one single ring shaped deformation.

Figure 4:
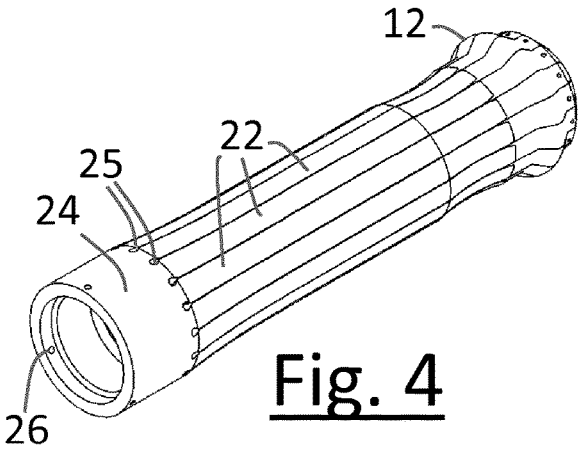
FIG. 4 is a perspective view of another suitable expansion device.
Figure 5:
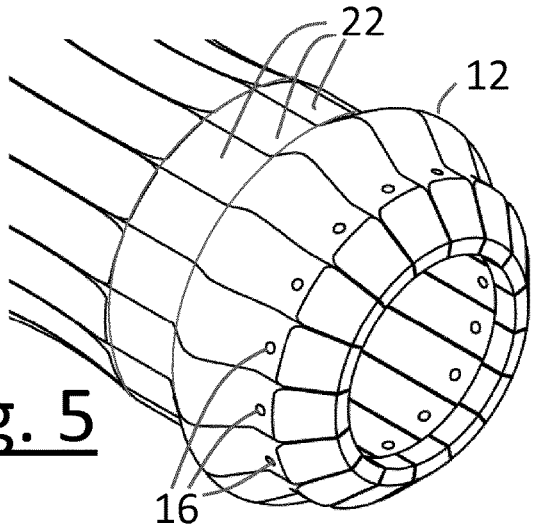
FIG. 5 is an enlarged perspective view of the segments of expansion device of FIG. 4 from a different angle of view.
Figure 6A:
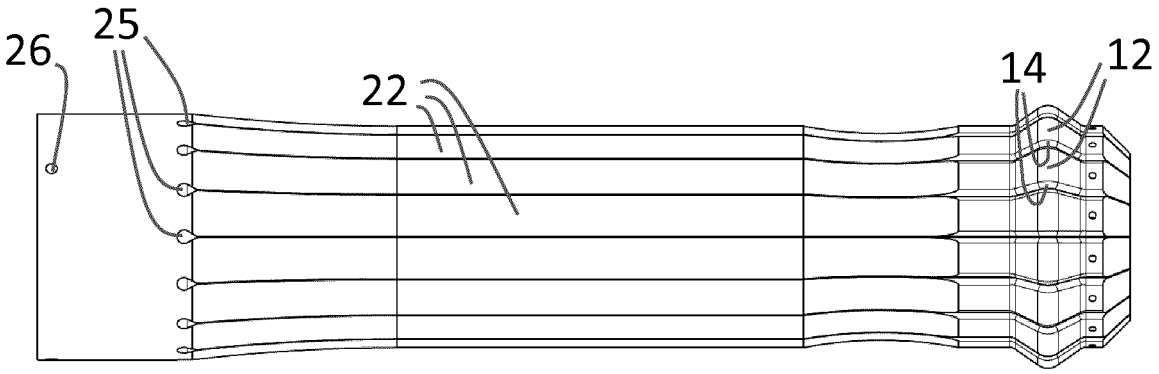
FIGS. 6*a* and 6*b* respectively are a side view and a longitudinal sectional view of the expansion device of FIG. 4.
Figure 6B:
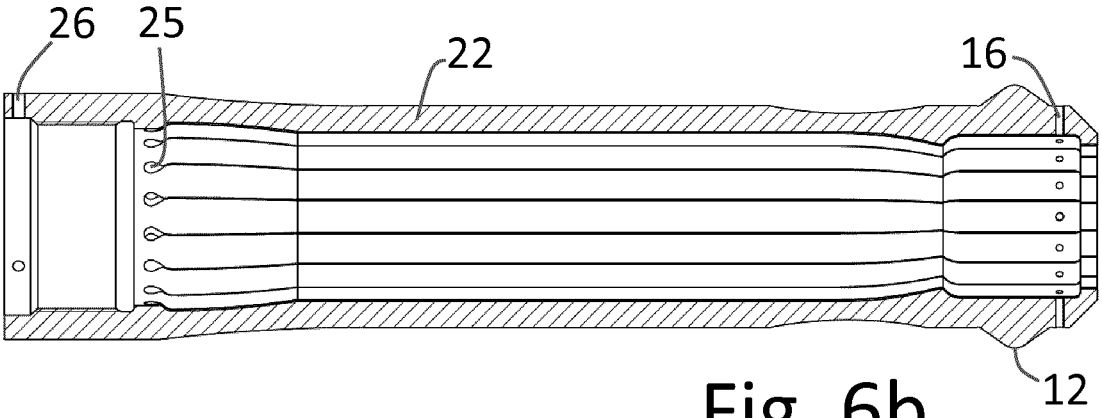
Figure 7A:
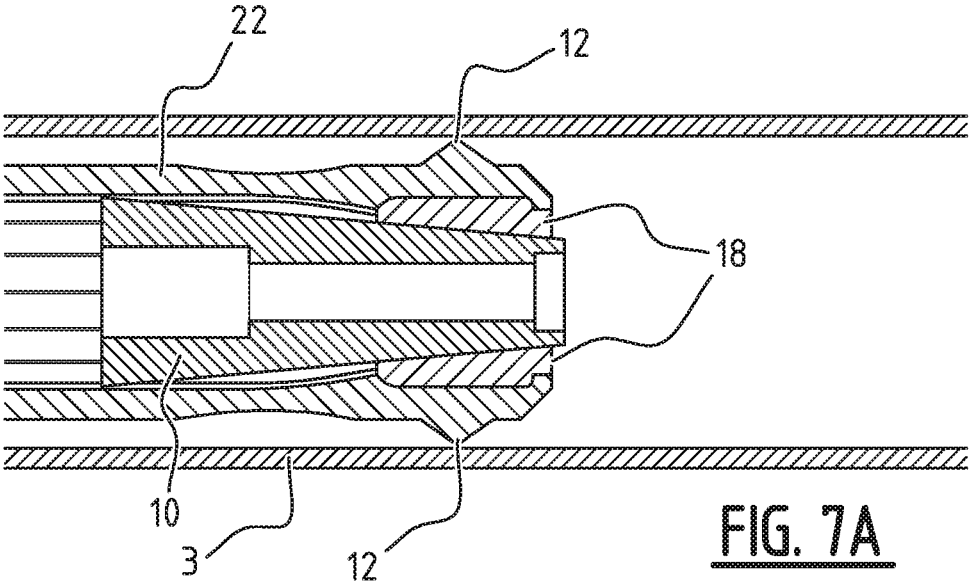
FIGS. 7*a* to 7*c* show subsequent stages of operation of the expansion devices of FIG. 4 in a well casing in longitudinal sectional views.
Figure 7B:
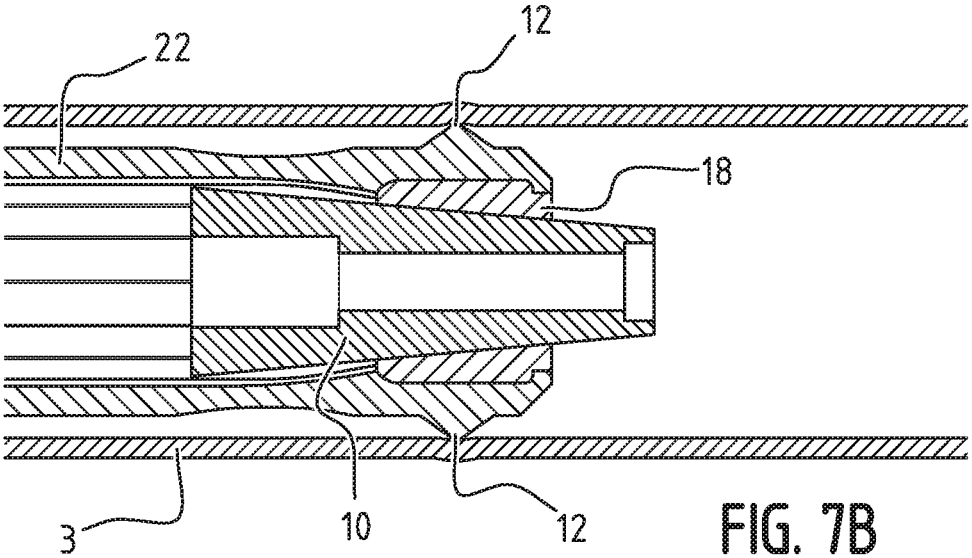
Figure 7C:
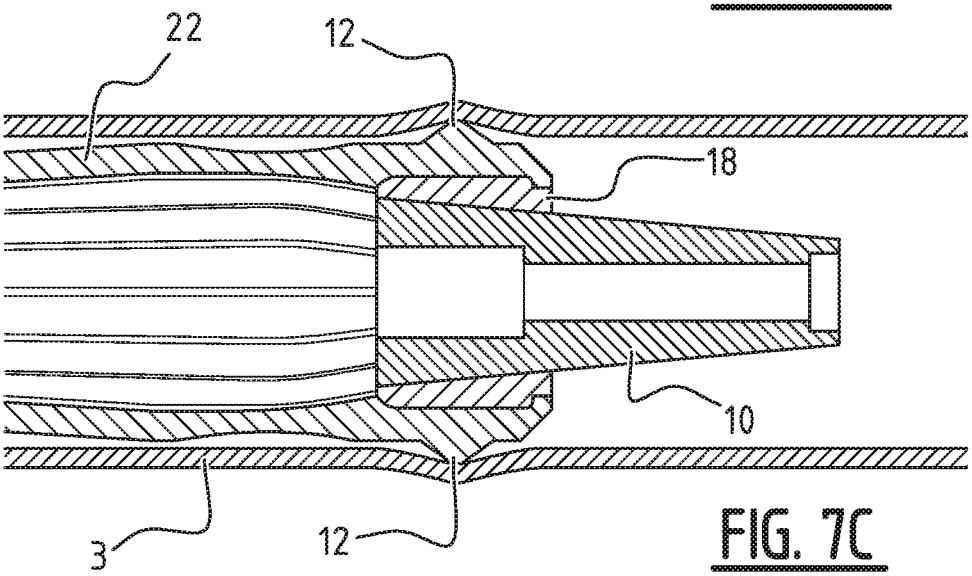

FIGS. 4-6 show another expansion device suitable for carrying out the method. In this embodiment, the expandable segments are embodied in the form of blades 22. The blades 22 are resiliently supported on a base ring 24. In the present embodiment, the blades 22 and the base ring form a monolithic piece. To avoid stress-concentrations, small pieces of material may be machined away from the base ring 24 at the edges of the blades 22, as indicated by excisions 25. The V-shaped outer edges 12 are provided at the other ends of the blades 22. The base ring 24 may be provided with connector means 26 to secure the tool to an actuator sub (not shown). Each blade 22 may also be provided with one or more transverse through openings 16, for securing a contact block on the internal side of each blade 22, which is optimized to slidingly contact with facets of an internal wedge (the internal wedge is shown in FIGS. 7*a*-7*c*). Other connection means may be employed instead or in addition thereof, including welds or adhesives. Similar to the previous embodiment, the outer edges 12 may, in circumferential direction, be rounded off at the edges, for example by tapered facets 14.

Referring now to FIGS. 7*a*-7*c*, there expansion device of FIGS. 4 to 6 is shown in operation inside a well casing 3. In these figures, the cone shaped expander 10 is visible, which can be moved in longitudinal direction relative to the blades 22, when actuated. The driving force for the movement may be hydraulically applied via a hydraulic actuation assembly (not show). Suitably, the cone shaped expander 10 slides along a central longitudinal mandrel (not shown). The cone may have facets, which slidingly engage with contact blocks 18 which are secured in recesses within the blades. Each facet suitably engages with one contact block 18. The contact blocks 18 may be constructed from a different material than the blades 22. The expansion cone 10 may be constructed from yet another material. All materials are preferably different grades of chromium/molybdenum/vanadium steel and/or chromium steel. Alternatively other types of high strength corrosion resistant materials may be employed, such as nickel alloys.

After moving the device in unexpanded condition to the selected location within the well casing 3, as shown in FIG. 7*a*, the hydraulic system is actuated upon which the expansion cone 10 is moved inside the blades 22, which in turn will elastically move radially outward until the V-shaped edges 12 of the segments engage with the inside surface of the well casing 3 (FIG. 7*b*). Upon further movement of the expansion cone 10, the V-shaped edges 12 will be forced into the casing 3 and the surrounding hardened cement as described hereinabove. This is shown in FIG. 7*c*. Upon retraction of the expansion cone 10, the blades 22 will contract elastically until the expansion device is again in unexpanded condition. By appropriate selection of the length of the blades, the thickness, the shape and the material, the elastic properties can be tuned to function. This way, a separate spring, such as the O-shaped elastomeric ring 13 as described in reference to FIGS. 1 and 2, may not be needed. When back in unexpanded condition, the expansion device can withdrawn from the wellbore or moved to another location within the well casing for repetition of the procedure.

Figure 8:
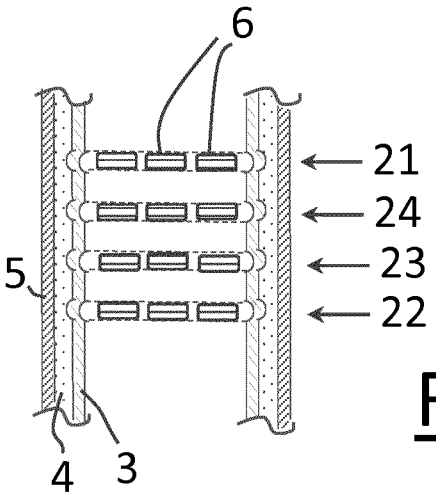
FIG. 8 illustrates a preferred sequence of locally expanding a casing.

FIG. 8 illustrates a preferred sequence of locally expanding the casing 3. Shown is a well bore after a sealing operation has been completed. First the unexpanded expansion device was moved to a selected first depth 21 in the well casing 3, upon which the edged expansion segments were expanded resulting in circumferentially spaced recesses 6 into the inner surface of the selected casing section. The outer surface of the selected the expanded casing section has been expanded into the surrounding cement sheath 4, while maintaining the expansion device located substantially stationary at the selected first depth 21. This was followed by moving the unexpanded expansion device to a selected second depth 22 in the well casing 3. The second depth 22 in this case is deeper than the selected first depth 21. It should not coincide with the first selected depth 21. The expanding step was repeated at the second selected depth 22. After that the unexpanded expansion device was moved to selected third and fourth depths 23 and 24 respectively. These are intermediate depths, between said first selected depth 21 and said second selected depth 22. Herewith it is achieved that the cement in the cement sheath 4 at the intermediate depths is even more put under stress when repeating the expansion steps there, as the prior expansion steps at the first and second depths 21 and 22 restrain the hardened cement from deformation along the annulus.

The method, system and/or any products are well adapted to attain the ends and advantages mentioned as well as those that are inherent therein.

The particular embodiments disclosed above are illustrative only, as the present invention may be modified, combined and/or practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined and/or modified and all such variations are considered within the scope of the present invention as defined in the accompanying claims.

While any methods, systems and/or products embodying the invention are described in terms of "comprising," "containing," or "including" various described features and/or steps, they can also "consist essentially of" or "consist of" the various described features and steps.

All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values.

Also, the terms in the claims have their plain, ordinary meaning unless otherwise explicitly and clearly defined by the patentee.

Moreover, the indefinite articles "a" or "an", as used in the claims, are defined herein to mean one or more than one of the element that it introduces.

If there is any conflict in the usages of a word or term in this specification and one or more patent or other documents that may be cited herein by reference, the definitions that are consistent with this specification should be adopted.

That which is claimed is:

1. A method for sealing cavities in or adjacent to a cured cement sheath surrounding a well casing of an underground wellbore, the method comprising the steps of:

providing an expansion device with edged expansion segments that is configured to be moved with the edged expansion segments in an unexpanded configuration up and down through a well casing which is surrounded by a cured cement sheath;

moving the unexpanded expansion device to a selected depth in the well casing; and expanding the edged expansion segments at the selected depth, thereby pressing circumferentially spaced recesses into an inner surface of a selected casing section and expand an outer surface of the selected casing section into the cured cement sheath thereby sealing the cavities.

2. The method of claim 1, subsequently comprising returning the expansion device to said unexpanded configuration before moving the unexpanded expansion device up or down through the wellbore.

3. The method of claim 2, wherein the sealing of the cavities persists after returning the expansion device to said unexpanded configuration.

4. The method of claim 1, wherein the cavities comprise micro-annuli in and/or adjacent to the cured cement sheath.

5. The method of claim 1, wherein during the expansion step the expansion device is located at a substantially stationary depth within the wellbore, and the method further comprising returning the expansion device to said unexpanded configuration after expansion of the selected casing section, and subsequently moving the unexpanded expansion device up or down through the wellbore to another depth and expanding the edged expanding segments at said other depth whereby another selected casing section is expanded to seal micro-annuli and/or other cavities at that other depth.

6. The method of claim 5, wherein the steps of expanding a selected casing section and moving the unexpanded expansion device up or down through the wellbore to another depth where another selected casing section is expanded are repeated several times to seal micro-annuli and/or other cavities at several depths along the length the wellbore.

7. The method of claim 1, comprising:

moving the unexpanded expansion device to a selected first depth in the well casing;

expanding the edged expansion segments at the first selected depth, thereby pressing circumferentially spaced recesses into an inner surface of the selected casing section and expand the outer surface of the selected the expanded casing section into the surrounding cured cement sheath, while maintaining the expansion device located at a substantially stationary depth; followed by:

returning the expansion device to said unexpanded configuration;

moving the unexpanded expansion device to a selected second depth in the well casing which does not coincide with the first selected depth;

repeating said expanding step at said second selected depth; followed by:

returning the expansion device to said unexpanded configuration;

moving the unexpanded expansion device to one or more selected intermediate depths in the well casing between said first selected depth and said second selected depth; and repeating said expanding and returning steps at each of said selected intermediate depths.

8. The method of claim 1, wherein the expansion segments have a substantially V-shaped outer contour in longitudinal direction, and are configured to expand the selected casing section such that it has a ring of substantially V-shaped circumferentially spaced recesses.

9. The method of claim 8, wherein the expansion segments have V-shaped edges with a segmented ring-shaped outer contour in circumferential direction, and are configured to expand the selected casing section such that the recesses have a substantially V-shaped inner contour in longitudinal direction, which section is connected to adjacent non-expanded casing sections by smoothly outwardly curved concave semi-expanded casing sections.

10. The method of claim 9, wherein the length of the substantially V-shaped edge is less than 20 cm.

11. The method of claim 1, wherein at least part of the outer surface of the expanded casing section and of the surrounding cured cement sheath is plastically deformed as a result of the expansion.

12. The method of claim 1, wherein the expansion device comprises a hydraulic actuation assembly that radially expands and contracts the expansion segments.

13. The method of claim 1, wherein the expansion device is suspended from one of the group consisting of: a tubular string, a wireline and an e-line; through which electric power and/or signals can be transmitted between the expansion device and a control assembly at the earth surface.

* * * * *